US005987677A

United States Patent [19]

Betker

[11] Patent Number: 5,987,677

[45] Date of Patent: Nov. 23, 1999

[54] COUNTER-TOP MOUNTED INFANT CHANGING STATION

[75] Inventor: Mark A. Betker, Castle Rock, Colo.

[73] Assignee: Koala Corporation, Denver, Colo.

[21] Appl. No.: 08/883,550

[22] Filed: Jun. 26, 1997

[51] Int. Cl.[6] ..... A61G 13/00

[52] U.S. Cl. ..... 5/655; 5/947

[58] Field of Search ..... 5/655, 947, 136, 5/625; D6/553, 555, 559; 269/289, 306, 309

[56] References Cited

U.S. PATENT DOCUMENTS

| | | | |
|---|---|---|---|
| D. 229,457 | 12/1973 | Mathiseson | D6/1 |
| D. 302,088 | 7/1989 | Burt | D6/555 |
| D. 326,384 | 5/1992 | Burt et al. | 5/947 |
| D. 327,786 | 7/1992 | Ferrell | D6/397 |
| D. 367,771 | 3/1996 | Julian | D6/333 |
| D. 378,966 | 4/1997 | Helmsderfer | D6/555 |
| 2,973,889 | 3/1961 | Phillips | 5/655 |
| 3,644,947 | 2/1972 | Padera | 5/92 |
| 3,656,193 | 4/1972 | Schneider et al. | 5/92 |
| 3,721,434 | 3/1973 | Spies | 269/328 |
| 4,048,684 | 9/1977 | Korner et al. | 5/655 |
| 4,079,728 | 3/1978 | Gatts | 5/655 |
| 4,216,951 | 8/1980 | Griffin | 269/328 |
| 4,234,977 | 11/1980 | Snow | 5/655 |
| 4,466,146 | 8/1984 | Regan | 5/98 B |
| 4,522,381 | 6/1985 | Ludwick | 269/328 |
| 4,566,130 | 1/1986 | Coates | 383/15 |
| 4,573,608 | 3/1986 | Hansen | 221/92 |
| 4,613,996 | 9/1986 | Chase et al. | 5/2 R |
| 4,723,493 | 2/1988 | Siani et al. | 108/134 |
| 4,796,314 | 1/1989 | Garduno | 5/98 A |
| 4,874,340 | 10/1989 | Smallwood | 446/28 |
| 4,876,970 | 10/1989 | Bolduc | 108/55 |
| 4,895,742 | 1/1990 | Schaub et al. | 428/35.5 |
| 4,935,973 | 6/1990 | Behrman | 5/2 R |
| 5,081,724 | 1/1992 | Takahashi et al. | 5/136 |
| 5,086,527 | 2/1992 | Takahashi et al. | 5/136 |
| 5,297,305 | 3/1994 | Williams | 5/655 |
| 5,299,336 | 4/1994 | Marteeny | 5/655 |
| 5,339,470 | 8/1994 | Shamie | 5/98.1 |
| 5,345,880 | 9/1994 | Shamie | 108/63 |
| 5,459,877 | 10/1995 | Roberti | 2/104 |
| 5,491,850 | 2/1996 | Kiester | 4/572.1 |
| 5,546,620 | 8/1996 | Matthews | 5/655 |
| 5,588,159 | 12/1996 | Poulson et al. | 4/572.1 |

*Primary Examiner*—Michael F. Trettel
*Assistant Examiner*—Fredrick Conley
*Attorney, Agent, or Firm*—Sheridan Ross P.C.

[57] ABSTRACT

An infant changing apparatus configured to be mounted to a counter-top. The infant changing apparatus can be mounted to a top surface or bottom surface of a counter-top, and may extend into a hole or depression provided in the counter-top. A method for producing a surface mounted and recess mounted infant changing apparatus using a single mold is also disclosed. The method includes the steps of forming a surface mounted infant changing apparatus using, for example, a molding process, and then removing a portion thereof to produce a recess mounted diaper changing apparatus.

30 Claims, 5 Drawing Sheets

COUNTER-TOP MOUNTED INFANT CHANGING STATION

BACKGROUND OF THE INVENTION

The present invention relates to an infant changing station. More particularly, it relates to an infant changing station that can be mounted to a counter-top.

Parents of babies and infants not yet toilet trained often face a dilemma when visiting a public establishment, such as a restaurant, retail store, health club, etc. Namely, the child will soil his or her diaper, and require changing. Unfortunately, many rest rooms are not designed to facilitate easy changing of the infant's diaper. Changing of a diaper normally requires a generally flat surface on which to lay the baby or infant, removing the diaper, cleaning the child and placing a new diaper on the child. This is often done on a counter-top within the restroom.

Using a counter-top to change a soiled diaper provides a number of safety and health concerns, some of which are discussed below. First, counter-tops are essentially flat and often have at least one edge that opens to the floor. Thus, an inherent danger exists in that the baby may roll or fall off the open unprotected edges. Second, the opportunity for unintentional contamination or dirtying of the counter-top is quite prevalent. While a restroom operator can periodically clean the counter-top, some subsequent users of the counter-top will likely be exposed to unsanitary conditions. This is particularly true since typically no specific diaper changing area is designated, and thus the subsequent users of the counter-top cannot intentionally avoid the contaminated areas.

These problems have been partially addressed with the advent of wall-mounted infant changing stations. Wall-mounted changing stations are attached to a wall in the facility's rest room. To this end, a standard wall-mounted infant changing station includes a frame to which a bed is pivotably attached. More particularly, the standard wall-mounted changing station further includes a hinge means attaching the bed to the frame in conjunction with a support system. When not in use, the bed folds tightly against the frame, thereby limiting space requirements. To use the station, the user simply pivots the bed away from the frame, providing a flat table for changing diapers. The support system supports and maintains the bed relative to the frame in the open position.

For some applications, however, wall-mounted changing stations may not be economically feasible or otherwise undesirable. This may be particularly true for facilities that already have adequate counter space to accommodate a diaper changing area. For these applications, there is a need for a counter-top mounted infant changing station.

SUMMARY OF THE INVENTION

The present invention overcomes many of the limitations of the prior art by providing a counter-top mounted infant changing apparatus that limits the mobility of the baby, provides a designated diaper changing area within the facility's rest room, and provides a surface that is easily cleanable. Generally, the infant changing apparatus of the present invention includes a bed, an attachment region for attaching the bed to either the top or bottom surface of a counter-top, and an optional lip therebetween.

When attached to the top surface of the counter-top, it is contemplated that the infant changing apparatus can be either surface mounted or recess mounted. For the surface mounted embodiments, the bed is positioned at or above the plane formed by the attachment region. Thus, when the attachment region is affixed to the top surface of the counter-top, the bed is positioned above the counter-top. For the recess mounted embodiments, the bed is positioned below the attachment region such that the bed fits into a depression or hole cut into the top surface of the counter-top.

The attachment region may either extend outwardly a uniform distance from the outer periphery of the bed or optional lip, or may only extend outwardly from selected locations. In either case, the attachment region allows the attachment of the infant changing apparatus to the counter-top using any number of affixing means, including a suitable adhesive or a number of spaced screw holes.

To help limit the mobility of an infant, an optional lip may be provided between the bed and the attachment region. The lip may extend upwardly from the bed to a point that is higher than the attachment region, and thus higher than the top surface of the counter-top. The lip may also help contain the contaminants that are produced during a diaper change operation. A restraining belt may also be provided to further limit the mobility of the infant.

When installed, the bed may be substantially parallel to the plane of the counter-top (flat version), or may be angled relative to the plane of the counter-top so that the infant's torso is raised slightly relative to the infant's feet (angled version). Further, a depression may be formed in the surface of the bed for accommodating the infant's head. These features may increase the comfort for the infant during a diaper change operation.

A method for forming an infant changing apparatus that can be attached to the top-surface of a counter-top is also contemplated. The illustrative method includes the steps of forming a bed, a lip and at least one attachment region, wherein the attachment region is at or below the bed and the bed is at or below the attachment region. The method may also include the step of removing the attachment region such that the lip would engage the top surface of the counter-top, and the bed would extend at least partially into the hole or depression in the top surface of the counter-top.

Using this method, both the surface mounted infant changing apparatus and the recess mounted infant changing apparatus may be formed using a single mold. The surface mounted infant changing apparatus may be provided via the first step of the above method. That is, since the bed is above the attachment region, the bed will also be above the top surface of the counter-top when installed. Thus, the surface mounted infant changing apparatus may not require a hole or depression to be provided in the top surface of the counter-top. The recessed mounted infant changing apparatus may be provided by the second step, namely, removing the original attachment region. In the recess mounted embodiment, the lip is used to mount the diaper changing apparatus to the counter-top, rather than the original attachment region. Because the bed is located below the lip, the bed will be below the top surface of the counter-top when installed, and may extend into a hole or depression provided therein.

For those embodiments that are attached to the bottom surface of the counter-top, the infant changing apparatus is preferably in a recess mounted configuration. That is, the attachment region is configured to attach the infant changing apparatus to the bottom surface of the counter-top; the bed has an outer periphery and a lip that extends around at least part of the outer periphery of the bed; and the lip extends above the attachment region and at least partially into a hole cut into the counter-top. Like the top mounted embodiments discussed above, the bed may be substantially parallel or angled relative to the plane of the counter-top, and a depression may be formed in the surface of the bed for accommodating the infant's head.

Finally, a dispenser may be provided adjacent the infant changing apparatus, and on the top surface of the counter-top or on an adjacent wall. Alternatively, the dispenser may be attached to the infant diaper changing apparatus itself. The dispenser may allow a protective sheet material to be easily dispensed over the bed before each diaper change. Preferably, the protective material is paper or some other material that can be easily disposed of after each diaper change. The dispenser may reduce the contaminants that are transferred to the diaper changing apparatus, and thus may provide a relatively clean environment for each user of the infant changing apparatus.

DETAILED DESCRIPTION OF THE INVENTION

Figure 1:
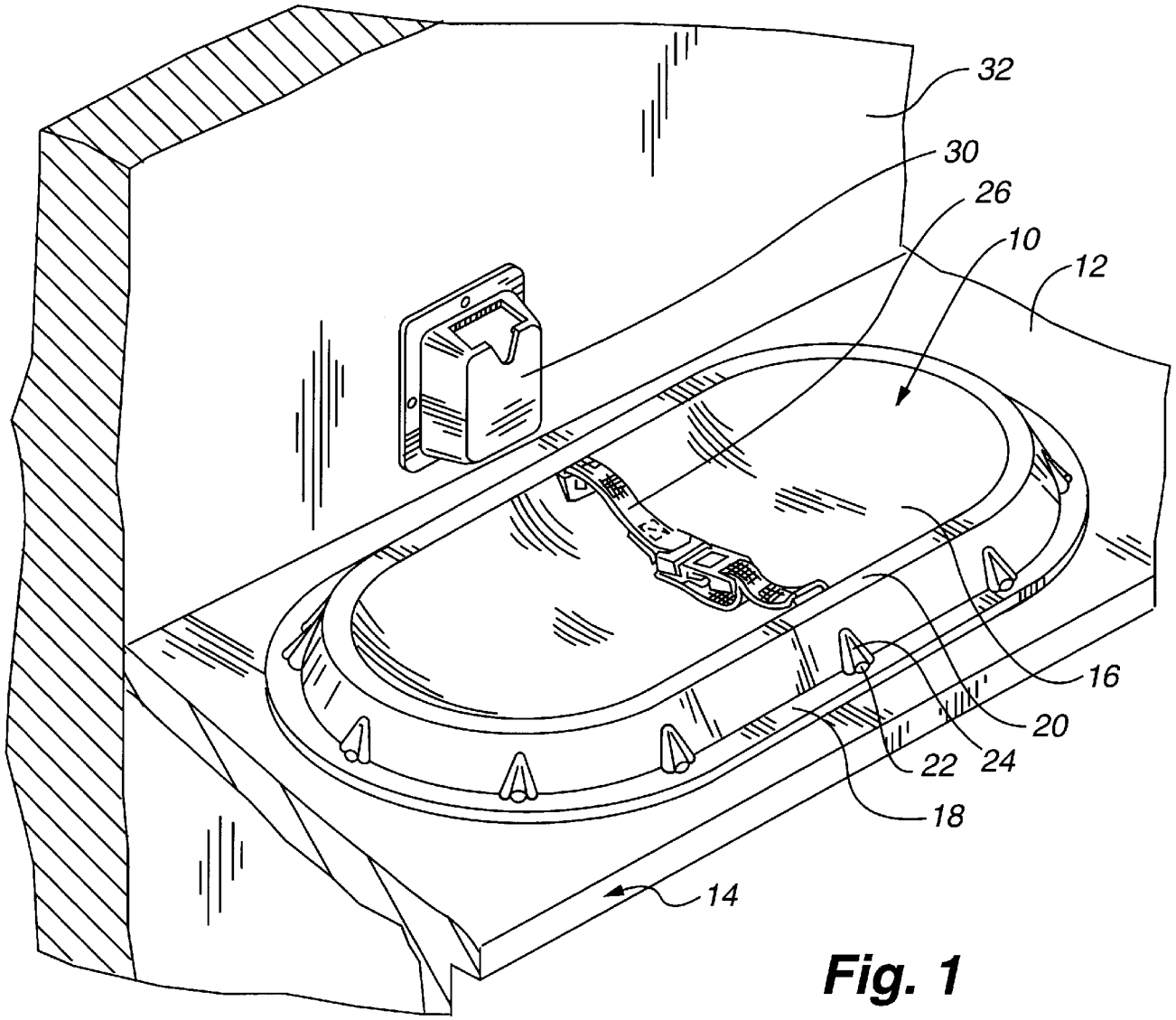
FIG. 1 is a perspective view of an illustrative surface mounted infant changing apparatus in accordance with the present invention.

FIG. 1 is a perspective view of an illustrative infant diaper changing apparatus in accordance with the present invention. The infant changing apparatus 10 is shown mounted to a top surface 12 of a counter-top 14 in a surface mounted configuration. The term "counter-top", as used herein, refers to any horizontal surface that is capable of supporting a diaper changing apparatus as described herein.

The infant changing apparatus 10 is preferably molded from a High Density Polyethylene (HDPE) sheet with anti-bacterial additives. The molding process may provide any desired surface texture and color, and preferably, a surface texture and color that matches a desired counter-top. As shown, the infant changing apparatus 10 preferably has an overall oval shape.

The infant changing apparatus 10 includes a bed 16, an attachment region 18, and a lip 20 located therebetween. Because the infant changing apparatus 10 is in a surface mounted configuration, the bed 16 is positioned at or above the plane formed by the attachment region 18. Thus, when the attachment region 18 is affixed to the top surface 12 of the counter-top 14, the bed 16 is positioned above the counter-top 14. No hole or depression is required in the counter-top 14 in the surface mounted configuration.

The attachment region 18 is shown extending outwardly a uniform distance from the entire periphery of lip 20. In the illustrative embodiment, the attachment region includes a number of spaced screw holes (e.g. screw hole 22) that allow the attachment of the infant changing apparatus 10 to the counter-top 14. Extending adjacent to each screw hole is a gusset (e.g. gusset 24). The gussets helps diffuse the stress that may be present at the screw holes. Although the use of screws are the preferred method for attaching the infant changing apparatus 10 to the counter-top 14, other affixing means are contemplated including using a suitable adhesive. Further, it is contemplated that the attachment region 18 may only extend out from the lip 20 at selected locations, and more particularly, at those locations where the screw holes are provided.

To help limit the mobility of an infant, lip 20 extends upwardly from the bed 16 to a point that is higher than the attachment region 18, and thus higher than the top surface 12 of the counter-top 14. The lip 20 may also help contain the contaminants that are produced during a diaper change operation. A restraining belt 26 is preferably provided to further limit the mobility of the infant.

When installed, the bed 16 may be substantially parallel to the plane of the counter-top 12 (flat version), or may be angled relative to the plane of the counter-top 12 (see, FIG. 3) so that the infant's torso is raised slightly relative to the infant's feet (angled version). Further, a depression (see FIG. 3) may be formed in the surface of the bed for accommodating the infant's head. These features may increase the comfort for the infant during a diaper change operation.

Finally, a dispenser 30 may be provided adjacent the infant changing apparatus 10. The dispenser 30 may be mounted on the top surface 12 of the counter-top 14 or on an adjacent wall 32. Alternatively, it is also contemplated that the dispenser 30 may be attached to the infant diaper changing apparatus itself, and in particular, to the attachment region 18. The dispenser 30 allows a protective sheet material (not shown) to be easily dispensed over the bed 16 before each diaper change. Preferably, the protective material is paper or some other material that can be easily disposed of after each diaper change. Thus, the dispenser 30 may reduce the contaminants that are transferred to the diaper changing apparatus 10, and may provide a relatively clean environment for each user of the infant changing apparatus 10.

Figure 2:
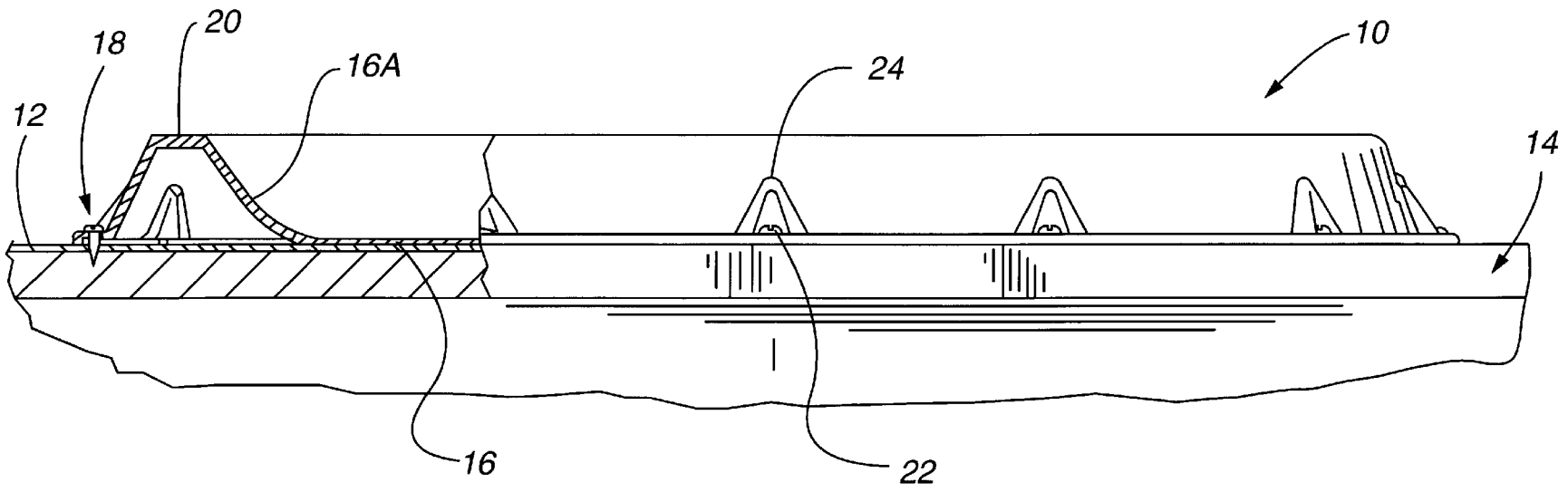
FIG. 2 is a cross-sectional side view of the surface mounted infant changing apparatus of FIG. 1.

FIG. 2 is a cross-sectional side view of the surface mounted infant diaper changing apparatus 10 of FIG. 1. The bed 16 is shown positioned in the same plane as the attachment region 18. Thus, both the bed 16 and the attachment region 18 may contact the top surface 12 of the counter-top 14. It is contemplated, however, that the bed 16 may be positioned above the plane formed by the attachment region 18. In this configuration, a space (not shown) would be provided between the bed 16 and the top surface 12 of the counter-top 14. The attachment region 18 includes a number of spaced screw holes (e.g. screw hole 22) that allow the attachment of the infant changing apparatus 10 to the counter-top 14.

To help limit the mobility of the infant, lip 20 extends upwardly from the bed 16 to a point that is higher than the attachment region 18, and thus higher than the top surface 12 of the counter-top 14. The outer lateral edges 16A of the bed may curve in an upward direction to meet the lip 20, as shown. This may provide a contoured bed surface for receiving an infant, which is easily cleanable.

Figure 3:
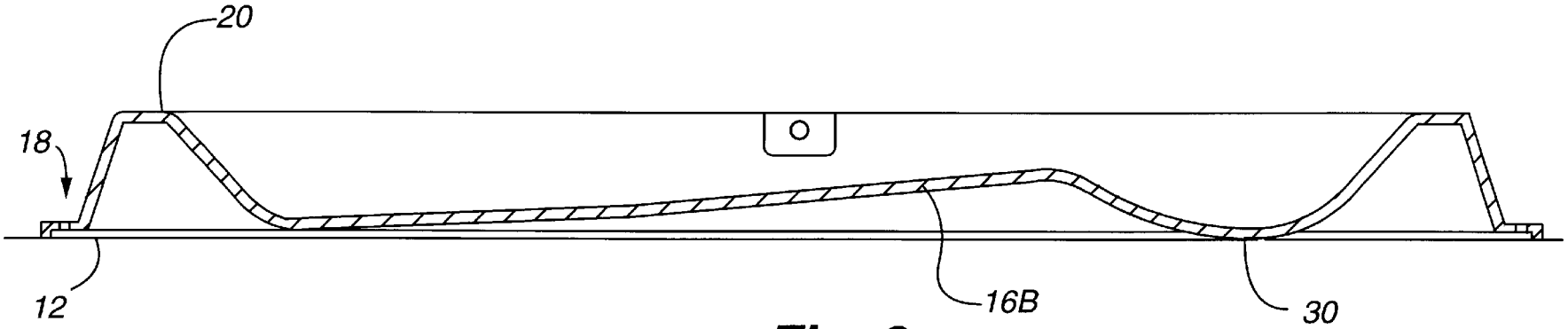
FIG. 3 is an alternative cross-sectional side view of the surface mounted infant changing apparatus of FIG. 1, with an alternative bed shape.

FIG. 3 is an alternative cross-sectional side view of the surface mounted infant changing apparatus of FIG. 1, with an alternative bed shape. In this embodiment, the bed 16B is angled relative to the plane of the top surface 12 of the counter-top. Thus, the infant's torso, when placed on the bed 16B, is raised slightly relative to the infant's feet. Further, a depression 30 may be formed in the surface of the bed for accommodating the infant's head. These features may increase the comfort for the infant during a diaper change operation.

Figure 4:
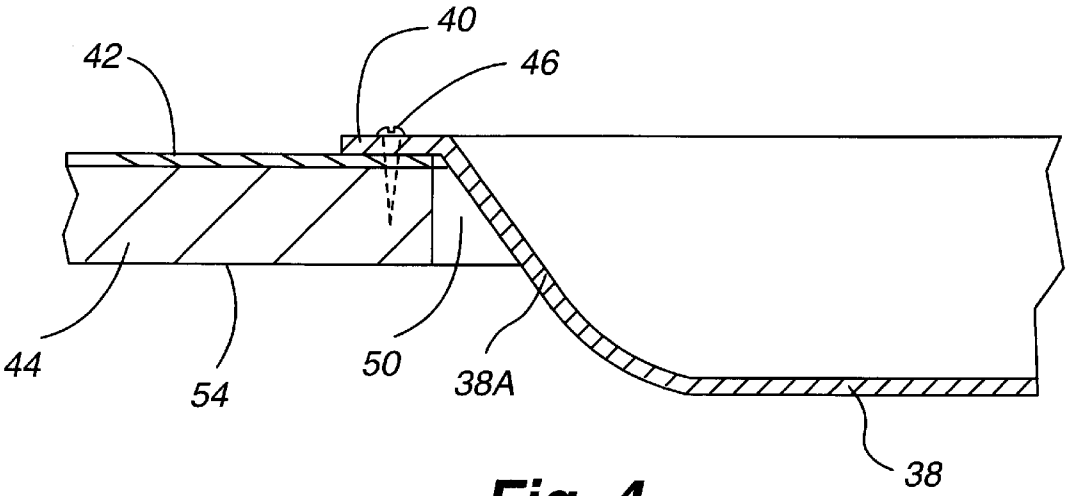
FIG. 4 is a partial cross-sectional side view of a first embodiment of a recess mounted infant changing apparatus.

FIG. 4 is a partial cross-sectional side view of a first embodiment of a recess mounted infant changing apparatus 36. In this embodiment, the infant changing apparatus 36 has a bed 38 and an attachment region 40. The edges 38A of the bed 38 curve in an upward direction to meet the attachment region 40, as shown. No lip is provided in this embodiment.

As is shown, the infant changing apparatus 36 is mounted such that the bed 38 extends below the attachment region 40, and thus below the top surface 42 of the counter-top 44. To this end, a hole 50 is provided in the counter-top, and the bed 38 is positioned in the hole 50. The hole is sized such that the attachment region 40, which preferably extends around the entire periphery of the bed 38, overlaps the top surface 42 of the counter-top 44. Screws 46 or other affixing means may then be used to affix the attachment region 40, and thus the infant changing apparatus 36, to the top surface 42 of the counter-top 44. It is contemplated that the hole 50 may only be a depression in the counter-top 44 if the bed 38 is not positioned below the bottom surface 54 of the counter-top 44.

Figure 5:
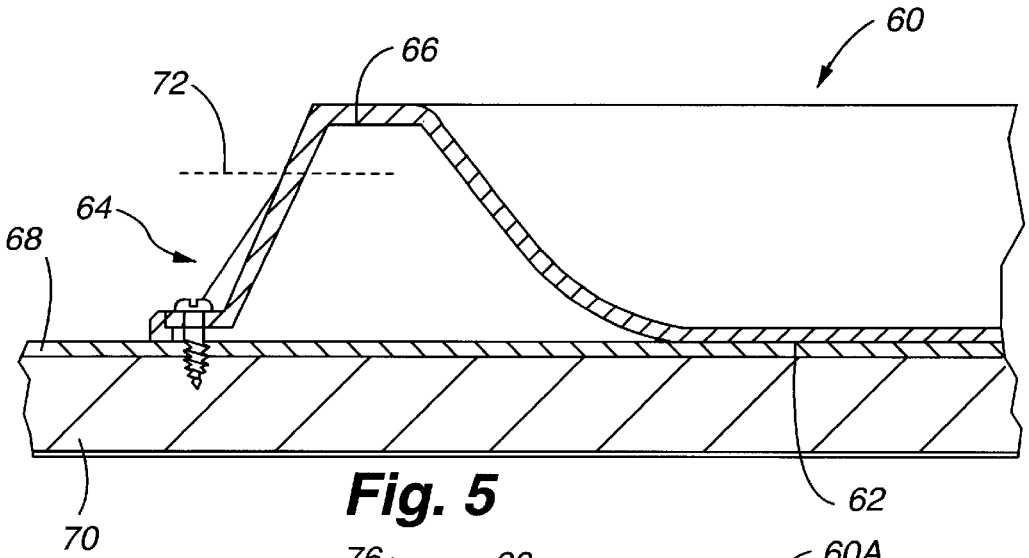
FIG. 5 is a partial cross-sectional side view of a transformable infant changing apparatus, in a surface mounted configuration.
Figure 6:
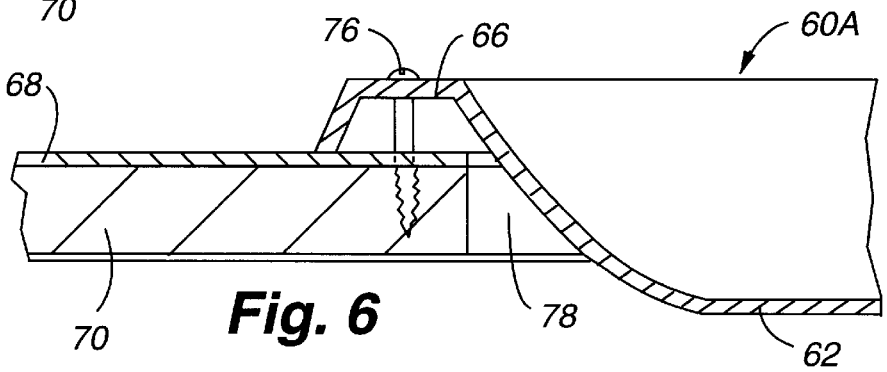
FIG. 6 is a partial cross-sectional side view of the transformable infant changing apparatus of FIG. 5, in a recess mounted configuration.

FIG. 5 and FIG. 6 are partial cross-sectional side views of a convertible infant changing apparatus. FIG. 5 shows the convertible infant changing apparatus in a surface mounted configuration. FIG. 6 shows the convertible infant changing apparatus in a recess mounted configuration.

The surface mounted configuration shown in FIG. 5 is similar to the embodiment shown and described with reference to FIGS. 1–2. That is, the convertible infant changing apparatus 60 includes a bed 62, a lip 66 and an attachment region 64, wherein the attachment region 64 is at or below the bed 62, and the bed 62 is at or below the lip 66 as shown. Because the bed 62 is at or above the attachment region 64, the bed 62 will always be above the top surface 68 of the counter-top 70 when installed. Thus, the surface mounted infant changing apparatus 60 may not require a hole or depression in the top surface 68 of the counter-top 70.

To transform the surface mounted infant diaper changing apparatus 60 into the recess mounted infant changing apparatus 60A (see FIG. 6), the attachment region 64, which in this embodiment is located below dotted line 72, is removed. This can be accomplished by cutting, grinding, or any other removal means. The result is shown in FIG. 6. After removal of the attachment region 64, the lip 66 rests on the top surface 68 of the counter-top 70, as shown. Thus, in the recess mounted infant diaper changing apparatus 60A, the lip 66 is used to mount the diaper changing apparatus to the counter-top 70, rather than the original attachment region 64.

Because the bed 62 is located below the lip 66, the bed 62 is positioned below the top surface 68 of the counter-top 70 when installed, and may extend into a hole 78 or depression provided therein. Thus, to transform the surface mounted infant changing apparatus to a recess mounted infant changing apparatus, at least a portion of the attachment region 64 is removed such that the infant changing apparatus is in a surface mounted configuration when the attachment region 64 is in place (see FIG. 5), and in a recess mounted configuration when the attachment region is removed (see FIG. 6). A number of screws, like screw 76, may be used to affix the lip 66 to the counter-top 70.

Accordingly, a method for forming a convertible or transformable infant changing apparatus is contemplated. The illustrative method includes the steps of forming a bed, a lip and at least one attachment region, wherein the attachment region is at or below the bed and the bed is at or below the lip. The method further includes the step of removing the attachment region such that the lip would engage the top surface of the counter-top, and the bed would extend at least partially into the hole or depression in the top surface of the counter-top.

Using this method, both the surface mounted infant changing apparatus and the recess mounted infant changing apparatus may be formed using a single mold. The surface mounted infant changing apparatus may be provided via the first step of the above method. That is, since the bed is above the attachment region, the bed will also be above the top surface of the counter-top when installed. Thus, the surface mounted infant changing apparatus may not require a hole or depression to be provided in the top surface of the counter-top.

The recess mounted infant changing apparatus may be provided by the second step, namely, removing the original attachment region. In the recess mounted embodiment, the lip is used to mount the diaper changing apparatus to the counter-top, rather than the original attachment region. Because the bed is located below the lip, the bed will be below the top surface of the counter-top when installed, and may extend into a hole or depression provided therein.

Figure 7:
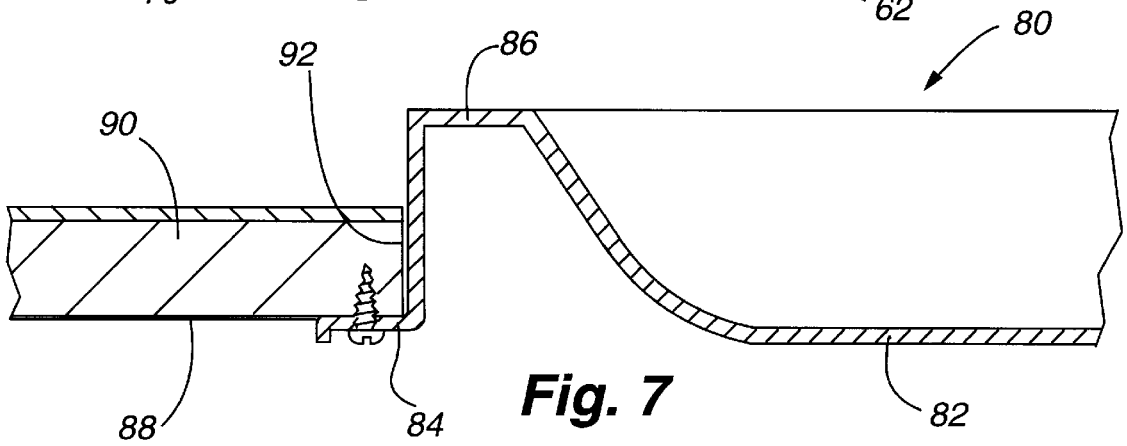
FIG. 7 is a partial cross-sectional side view of an infant changing apparatus that is mounted to the bottom surface of a counter-top, and through a hole in the counter-top.

FIG. 7 is a partial cross-sectional side view of an infant changing apparatus that is mounted to the bottom surface of a counter-top, and through a hole in the counter-top. The attachment region 84 is configured to attach the infant changing apparatus 80 to the bottom surface 88 of the counter-top 90. The bed 82 has an outer periphery and a lip 86 that extends around at least part of the outer periphery of the bed 82. Preferably, the lip 86 extends above the attachment region 84 and at least partially into a hole cut into the counter-top 90. The hole shown in FIG. 7 has an inner surface 92 that is substantially perpendicular to the plane of the counter-top 90.

Figure 8:
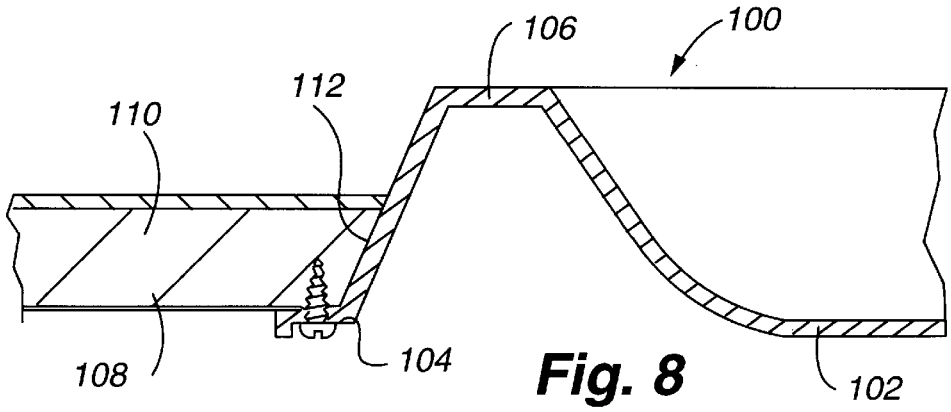
FIG. 8 is a partial cross-sectional side view of an infant changing apparatus that is mounted to the bottom surface of a counter-top, wherein the hole in the counter-top has an angled wall.
Figure 9:
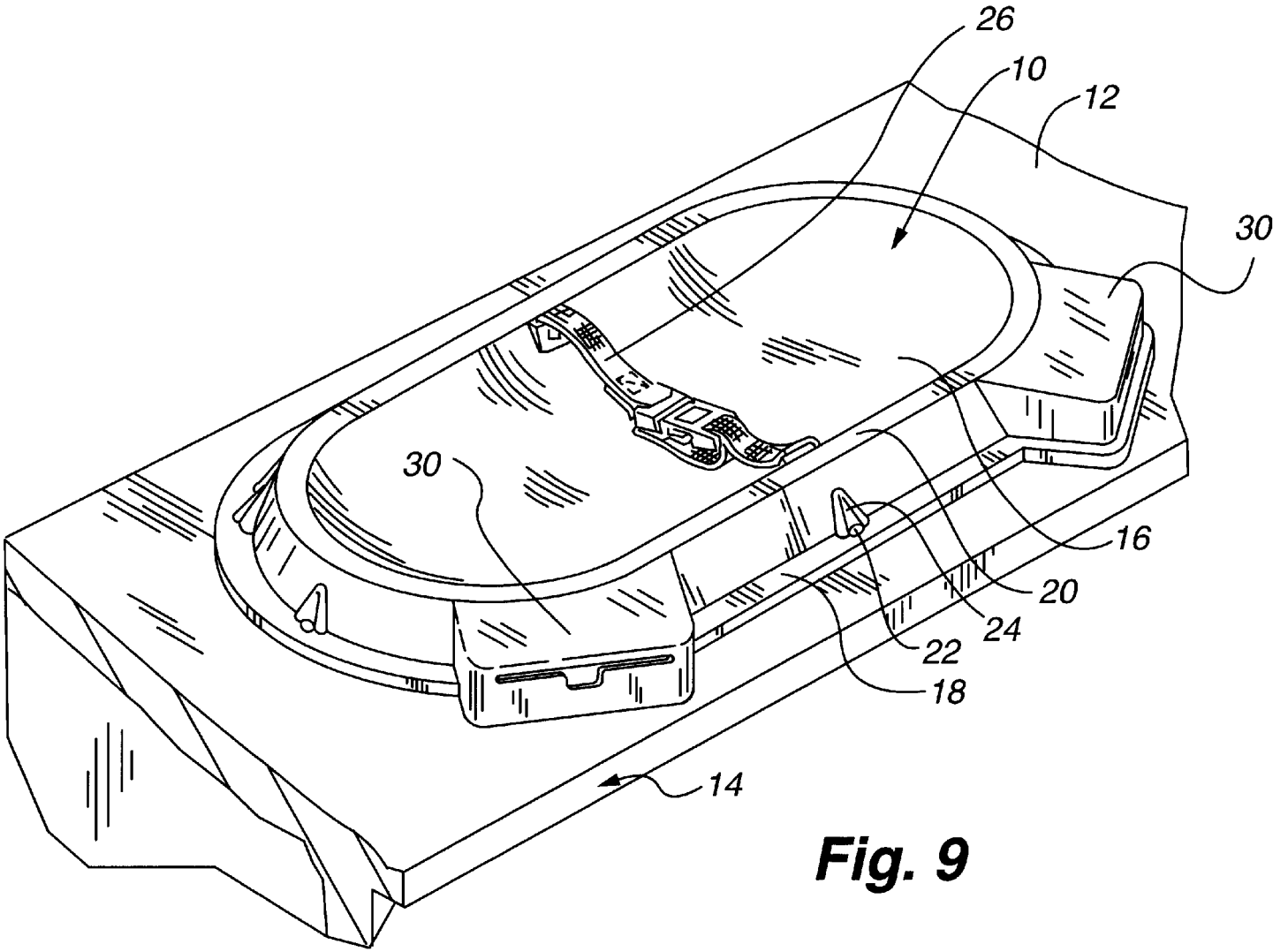

FIG. 8 is a partial cross-sectional side view of an infant changing apparatus that is mounted to the bottom surface of a counter-top, wherein the hole in the counter-top has an angled wall. Like the previous embodiment, the attachment region 104 is configured to attach the infant changing apparatus 100 to the bottom surface 108 of the counter-top 110. The bed 102 has an outer periphery and a lip 106 that extends around at least part of the outer periphery of the bed 102. The lip 106 preferably extends above the attachment region 104 and at least partially into a hole cut into the counter-top 110. The hole shown in FIG. 8 has an inner surface 112 that is angled relative a plane that is perpendicular to the counter-top 110. As is shown, the infant diaper changing apparatus 100 substantially conforms to the angled inner surface 112. For the embodiments shown in FIGS. 7–8, the attachment regions preferably include a number of screw holes for affixing the infant diaper changing apparatus to the bottom surface of the counter-top.

Having thus described the preferred embodiments of the present invention, those of skill in the art will readily appreciate that the teachings found herein may be applied to yet other embodiments within the scope of the claims hereto attached.

What is claimed is:

1. A substantially monolithic, seamless infant changing apparatus adapted for use in combination with a counter-top, wherein the counter-top includes a top planar surface with a depression or hole formed therein, the infant changing apparatus comprising:

at least one attachment region for attaching the infant changing apparatus to the top planar surface of the counter-top;

a bed positioned at least partially below said at least one attachment region, and adapted to fit within the depression or hole in the top surface of the counter-top; and a dispenser integrally interconnected to said at least one attachment region and adapted for allowing a disposable protective material to be dispensed and positioned over at least a portion of said bed;

a restraint belt having a first end and a second end interconnected to said bed and adapted for substantially confining an infant lying within said bed.

2. An infant changing apparatus according to claim 1 wherein said at least one attachment region extends outwardly a uniform distance from an outer periphery of said bed.

3. An infant changing apparatus according to claim 2 wherein said at least one attachment region has a number of spaced screw holes therein.

4. An infant changing apparatus according to claim 1 wherein said at least one attachment region comprises a number of spaced regions that extend outwardly from selected locations around the outer periphery of said bed.

5. An infant changing apparatus according to claim 4 wherein selected ones of said number of spaced regions have a screw hole therein.

6. An infant changing apparatus according to claim 1 wherein the top surface of the counter-top forms a plane, and wherein said bed is angled relative to the plane.

7. An infant changing apparatus according to claim 1 wherein said bed has a depression therein for receiving an infants head.

8. An infant changing apparatus according to claim 1, further comprising a lip interposed between said bed and said at least one attachment region, said lip extending around at least a portion of an outer periphery of said bed, and above said at least one attachment region.

9. An infant changing apparatus according to claim 8, wherein said lip extends around the outer periphery of said bed.

10. An infant changing apparatus according to claim 9, wherein said at least one attachment region extends outwardly from said lip and away from said bed.

11. An infant changing apparatus according to claim 10, wherein said lip has an outer periphery, and wherein said at least one attachment region extends outwardly a uniform distance from the outer periphery of said lip.

12. An infant changing apparatus according to claim 11, wherein said at least one attachment region has a number of spaced screw holes therein.

13. An infant changing apparatus according to claim 10, wherein said lip has an outer periphery, and wherein said at least one attachment region comprises a number of spaced regions that extend outwardly from selected locations around the outer periphery of said lip.

14. An infant changing apparatus according to claim 13, wherein selected ones of said number of spaced regions have a screw hole therein.

15. A substantially monolithic, seamless infant changing apparatus adapted for mounting on a counter-top, wherein the counter-top includes a bottom surface and a substantially planar upper surface, the infant changing apparatus comprising:

at least one attachment region for attaching the infant changing apparatus to the bottom surface of the counter-top;

a bed having an outer periphery;

a dispenser integrally interconnected to said at least one attachment region and adapted for allowing a disposable protective material to be dispensed and positioned over at least a portion of said bed;

a restraint belt interconnected to said bed for substantially confining an infant lying in said bed; and a lip extending around at least a portion of the outer periphery of said bed and secured to said at least one attachment region, said lip extending above said at least one attachment region and configured to fit at least partially into the hole of the counter-top.

16. An infant changing apparatus according to claim 15, wherein said lip extends around the entire outer periphery of said bed.

17. An infant changing apparatus according to claim 16, wherein said at least one attachment region extends outwardly from said lip and away from said bed.

18. An infant changing apparatus according to claim 17, wherein said lip has an outer periphery, and wherein said at least one attachment region extends outwardly a uniform distance from the outer periphery of said lip.

19. An infant changing apparatus according to claim 18, wherein said at least one attachment region has a number of spaced screw holes therein.

20. An infant changing apparatus according to claim 17, wherein said lip has an outer periphery, and wherein said at least one attachment region comprises a number of spaced regions that extend outwardly from selected locations around the outer periphery of said lip.

21. An infant changing apparatus according to claim 20, wherein selected ones of said number of spaced regions have a screw hole therein.

22. An infant changing apparatus according to claim 15, wherein the bottom surface of the counter-top forms a plane, and said bed is substantially parallel to the plane.

23. An infant changing apparatus according to claim 15, wherein the bottom surface of the counter-top forms a plane, and said bed is angled relative to the plane.

24. An infant changing apparatus according to claim 15, wherein the bottom surface of the counter-top forms a plane, and said bed is angled relative to the plane.

25. An infant changing apparatus according to claim 15 wherein said bed has a depression therein for receiving an infants head.

26. A method for forming an infant changing apparatus that can be mounted on a counter-top, wherein the counter-top includes a top surface and a hole or depression formed therein, the method comprising the steps of:

forming a bed, a lip and at least one attachment region, wherein the lip is provided around at least part of the bed, and the at least one attachment region is provided around at least part of the lip, the bed being positioned below the lip and at or above the at least one attachment region; and removing the at least one attachment region such that the lip would engage the top surface of the counter-top, and the bed would extend at least partially into the hole or depression in the top surface of the counter-top.

27. A method according to claim 26 wherein the bed, lip and the at least one attachment region are integrally formed.

28. A method according to claim 27 wherein the bed, lip and the at least one attachment region are integrally formed using a molding process.

29. A substantially monolithic, seamless infant changing apparatus adapted for mounting to a counter-top, wherein the counter-top includes a substantially planar top surface the infant changing apparatus comprising:

at least one attachment region adapted for attaching the infant changing apparatus to the substantially planar top surface of the counter-top;

a substantially concave shaped bed positioned below an upper lip which is interconnected to said at least one attachment region; and a dispenser integrally interconnected to the attachment region and adapted for allowing a protective material to be dispensed over the bed before each diaper change; and a restraint belt having a first end and a second end interconnected to said substantially concave bed and adapted for confining an infant to said bed while a user utilizes said infant changing apparatus.

30. An infant changing apparatus that can be mounted on a counter-top, wherein the counter-top includes a top surface with a depression or hole formed therein, the infant changing apparatus comprising:

at least one attachment region for attaching the infant changing apparatus to the top surface of the counter-top;

a bed positioned below said at least one attachment region, and configured to fit within the depression or hole in the top surface of the counter-top; and a dispenser positioned adjacent the attachment region for allowing a protective material to be dispensed over the bed before each diaper change.

* * * * *